US006669464B2

(12) United States Patent
Lin et al.

(10) Patent No.: US 6,669,464 B2
(45) Date of Patent: Dec. 30, 2003

(54) HOLIDAY ORNAMENT/CANDLE APPARATUS

(75) Inventors: Chun-Kuei Lin, Englewood Cliffs, NJ (US); Vincent Lin, Englewood Cliffs, NJ (US)

(73) Assignee: Silk Road Gifts, Carlstadt, NJ (US)

( * ) Notice: Subject to any disclaimer, the term of this patent is extended or adjusted under 35 U.S.C. 154(b) by 50 days.

(21) Appl. No.: 10/166,443

(22) Filed: Jun. 10, 2002

(65) Prior Publication Data

US 2003/0148237 A1 Aug. 7, 2003

Related U.S. Application Data

(60) Provisional application No. 60/355,487, filed on Feb. 7, 2002.

(51) Int. Cl.[7] ..... F23Q 2/32; F23D 3/16

(52) U.S. Cl. ..... 431/126; 431/253; 431/289

(58) Field of Search ..... D26/10; 431/126, 431/253, 289

(56) References Cited

U.S. PATENT DOCUMENTS

| | | | | | |
|---|---|---|---|---|---|
| 100,194 | A | | 2/1870 | Sargent | |
| 165,206 | A | | 7/1875 | Brown | |
| 676,273 | A | | 6/1901 | Platon | |
| 1,551,104 | A | | 8/1925 | Hawley | |
| 1,576,205 | A | | 3/1926 | Mertens | |
| 1,709,889 | A | | 4/1929 | Tasker | |
| 2,300,226 | A | | 10/1942 | Ketchum | |
| 2,508,933 | A | | 5/1950 | Walker | |
| D166,802 | S | | 5/1952 | De Berg | |
| 3,749,904 | A | * | 7/1973 | Graff | 362/265 |
| 3,753,643 | A | * | 8/1973 | Golden | 431/126 |
| 4,035,937 | A | | 7/1977 | Rosenfeld | |
| 4,040,149 | A | | 8/1977 | Einhorn | |
| 4,225,552 | A | | 9/1980 | Chang | |
| 4,304,547 | A | | 12/1981 | Buzil | |
| D274,367 | S | * | 6/1984 | Anderson | D26/10 |
| 4,696,640 | A | | 9/1987 | Pitchford | |
| 5,419,527 | A | | 5/1995 | Adams et al. | |
| 5,601,272 | A | | 2/1997 | Adams et al. | |
| 5,879,153 | A | * | 3/1999 | Slejertin | 431/295 |
| 5,927,964 | A | * | 7/1999 | Fawcett | 431/288 |
| 6,000,820 | A | * | 12/1999 | Murray | 362/441 |
| 6,443,364 | B1 | * | 9/2002 | Lin | 239/17 |

* cited by examiner

*Primary Examiner*—Alfred Basichas
(74) *Attorney, Agent, or Firm*—Woodbridge & Associates, PC; Richard C. Woodbridge, Esq.; Thomas J. Onka, Esq.

(57) ABSTRACT

A holiday ornament is attachable to a relatively soft candle in such a fashion that it is firmly held to the candle until the candle burns down far enough to permit the ornament to fall off. A metal strip is welded to the back of the ornament. The two opposite ends of the strip are bent upwardly, away from the soldered portion and disposed at an angle of approximately 10–15° so that, when pushed into the candle, the soft wax exerts a force on the two pins in order to keep it in place during normal use. The structure of the pins keeps the ornament in the vertical position until the candle has burned down at least half way, at which point the ornament falls off for lack of support. Thereafter, the ornament can be removed and placed on a holiday item, such as a Christmas Tree, wreath, etc.

8 Claims, 2 Drawing Sheets

HOLIDAY ORNAMENT/CANDLE APPARATUS

CROSS REFERENCE TO RELATED APPLICATIONS

This application is related to and claims the priority of U.S. Provisional Application Ser. No. 60/355,487, filed Feb. 7, 2002 and entitled "Holiday Ornament/Candle Apparatus". The entire content and subject matter thereof is hereby incorporated in total by reference.

BACKGROUND OF THE INVENTION

1. Field of the Invention

The invention relates to a holiday ornament which is attachable to a holiday candle in such a way that it is securely held in place when not in use but easily falls away from the candle after the candle has melted at least half way down.

2. Description of Related Art

The use of ornaments in the context of holiday candles, and the like, is known.

For example, U.S. Pat. No. 2,300,226 entitled "Candle Holder" describes an ornamental structure for attachment to a candle for the purpose of splicing two sections of the candle together in axial alignment by means of a clamping type structure.

Likewise, U.S. Pat. No. 2,508,933 describes candle ornaments comprising annular reinforcing/ornamental structures.

U.S. Pat. Nos. 5,419,527 and 5,601,272 describe ornamental structures which appear to surround and support a candle which, in turn, can be applied to a flat surface by a suction cup.

The following prior art references all appear to describe candles which incorporate various items, decoration and otherwise, as part of their exterior surface: U.S. Pat. Nos. 1,511,104; 1,576,205; 1,709,889; 4,039,937; 4,225,552; 4,304,547; and, 4,696,640.

With regard to U.S. Pat. No. 4,225,552, noted above, the decorative elements each include a stem portion by which they are mounted to the surface of the candle core before being enveloped by an outer shell of wax.

The following prior art references appear to describe pushpin structures typical of the prior art: 100,194; 165,206; 676,273; and 4,040,149.

With regard to U.S. Pat. No. 165,206 cited above, in particular, the structure includes a multi-prong pushpin which supports an ornament on an exposed surface. The opposite surface has a contacting structure with projecting prongs also.

Lastly, U.S. Design Pat. No. 166,802 describes a decorative candle having items apparently pinned thereon.

While the concept of applying ornamentation to almost any surface, including holiday candles, it is generally known, there does not appear to be taught or suggested by the prior art a satisfactory way of securely attaching a holiday ornament to a soft candle, such that it stays in place when the candle is not being used, and such that, when the candle has burned at least half way down, the ornament safely falls away from the candle structure and thereafter can be used in the conventional fashion hanging from a holiday plant or large decoration.

SUMMARY OF THE INVENTION

Briefly described, the invention comprises a holiday ornament, such as a Christmas Tree figurine, that is securely attachable to a holiday candle made of a moderately soft wax. The ornament, preferably formed from a metal or tin-like sheet, has a thin metal strip soldered to the back thereof with the opposite ends of the strip turned up away from the plane of the back of the ornament. The two turned up ends of the metal strip form a pair of pins. A flat tip is formed on the first and second pins, respectively, by means of a bevel of approximately 45°. Each of the two pins is angled at approximately 10–15° away from a plane perpendicular to the back of the ornament. This feature, in combination with the width of the pin and the bevel on the tips thereof, provides for a superior attachment to the soft wax of the candle when the candle is shipped or otherwise not being used. When the candle is lit, however, the wax burns down until it gets to a point near the second pin at which point the holiday ornament falls safely away from the candle. Thereafter, the ornament can be hung from a Christmas Tree, Christmas Wreath, fireplace, etc. in the conventional fashion, preferably by means of a small string attached to the top of the ornament.

These and other features of the invention will be more fully understood by reference to the following drawings.

DETAILED DESCRIPTION OF THE INVENTION

During the course of this description, like numbers will be used to identify like elements according to the different figures that illustrate the invention.

Figure 1C:
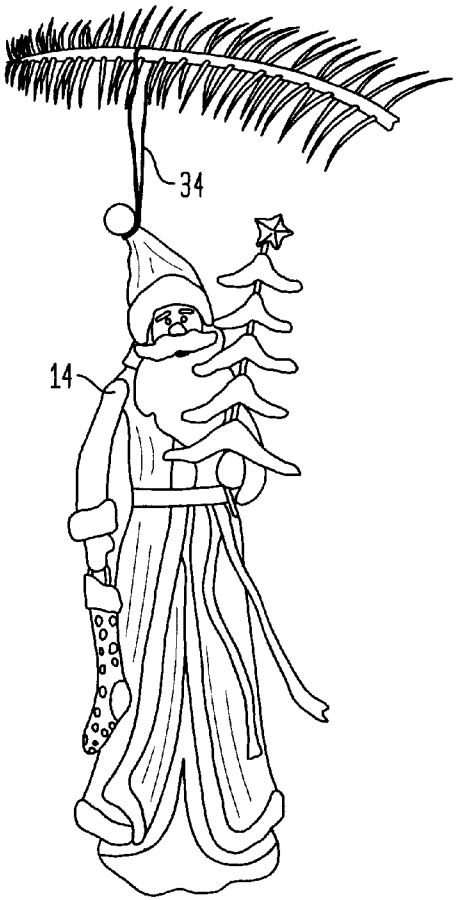
FIG. 1C shows how the ornament hanging from a Holiday object such as a Christmas Tree after it has separated from the candle.
Figure 1B:
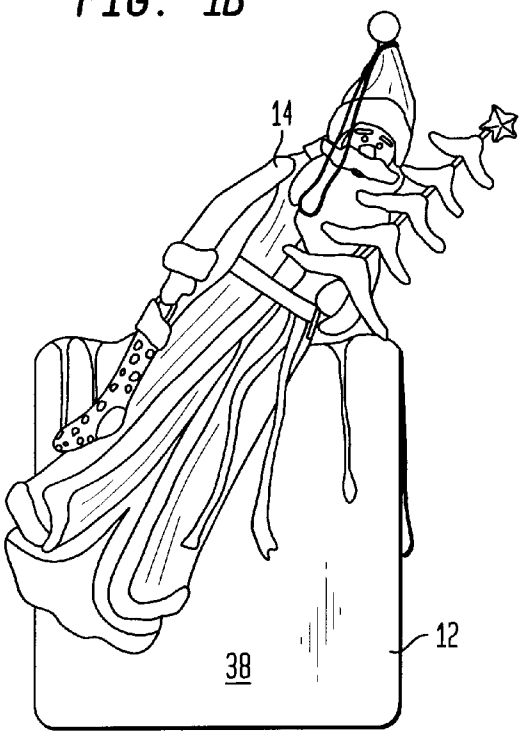
FIG. 1B shows the preferred embodiment of FIG. 1A as the candle melts down and the ornament separates therefore at the right moment.
Figure 1A:
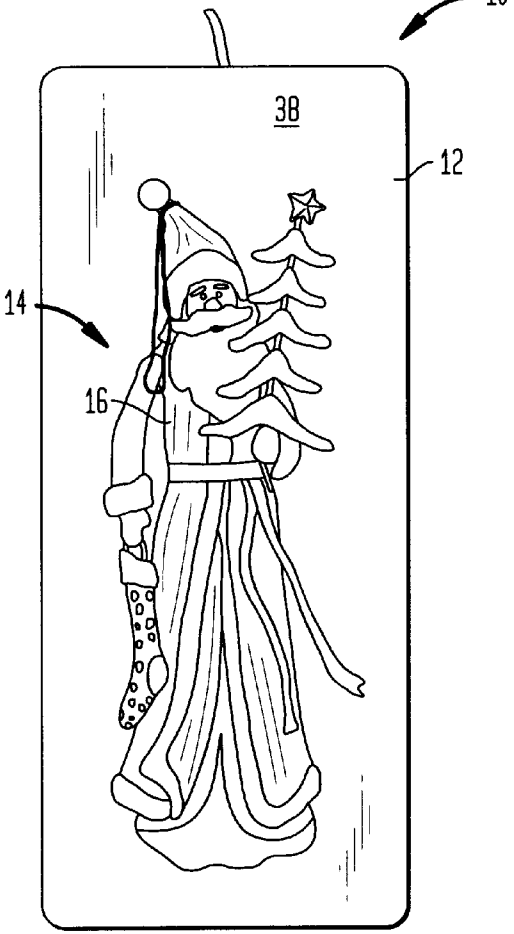
FIG. 1A is a front elevational view of the preferred embodiment of the invention showing a Holiday ornament pined to a Holiday candle.
Figure 2:
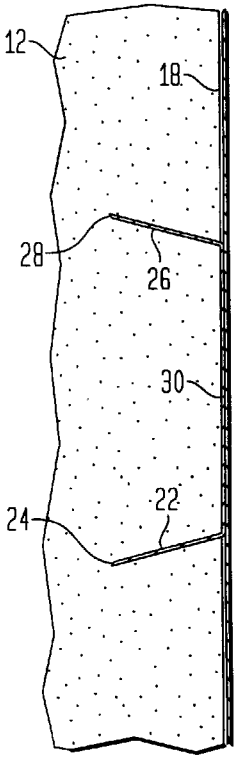
FIG. 2 is a cross sectional view of the ornament showing the two pins properly embedded in the Holiday candle, preferably made from a soft wax.

As shown in FIG. 1A, the invention 10 primarily includes a holiday candle 12 and a thin metal painted ornament 14 attached to a face or surface 38 of the candle 12. Ornament 14 includes a front face 16 and a back face 18 as shown in FIG. 2. When the candle 12 is shipped, or otherwise not being used, the ornament 14 is securely held to the back of the candle by means of a metal clip 20 shown in better detail in FIGS. 3A–3C.

FIG. 1B illustrates the preferred embodiment 10 of FIG. 1A as the candle 12 melts down and the ornament 14 naturally separates from the candle. It is important that the ornament 14 not separate from the candle 12 until the candle 12 has burned down at least half way at which point it can fall off safely.

Once the ornament 14 has fallen away from the melted candle 12, it can be placed on a holiday item, such as a Christmas Tree, Christmas Wreath, fireplace, etc. by means of attachment string 34 or any other suitable well known means of attachment such as safety pins, rubber bands, etc. as shown in FIG. 1C.

FIG. 2 is a cross sectional detail of the ornament 14 attached to the face or sidewall 38 of candle 12, similar to that shown in FIG. 1A and illustrating in a manner in which the first and second pins 22 and 26, respectively, hold the ornament 14 securely in place until the melting of the candle releases the ornament 14 at the proper time. Clip 20 is especially suitable for modern candles 12 made of soft wax which includes significant amounts of coconut oil and the like. It is hard to get a good purchase on soft wax, such as that just described, with conventional pushpins and the like. Another problem is that the natural heat conductive capacity of the ornament 14 is such that an attachment with either a single pin or a small pin would heat up to too quickly and fall off prematurely, well before the desired time due to the conductive heating of the entire structure by the candle flame itself.

Figure 3A:
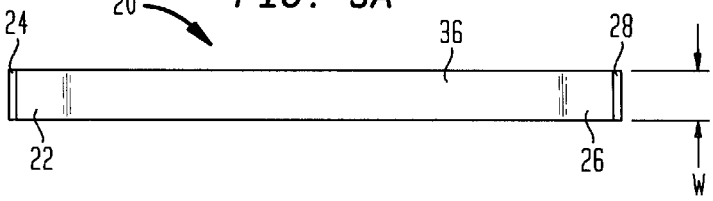
FIG. 3A is a top plan, close up view of the pins attached to the back of the ornament.
Figure 3B:
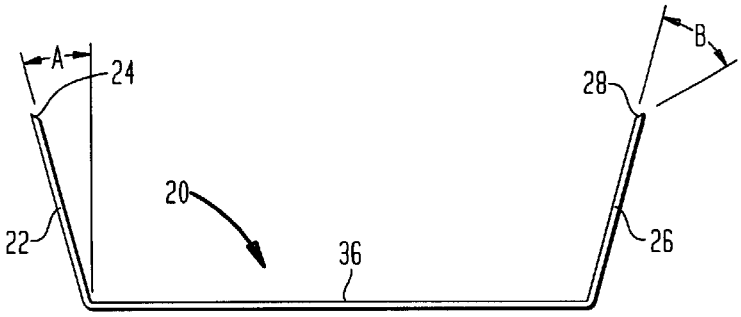
FIG. 3B is a side elevational view showing the beveled tips of the two pins.
Figure 3C:
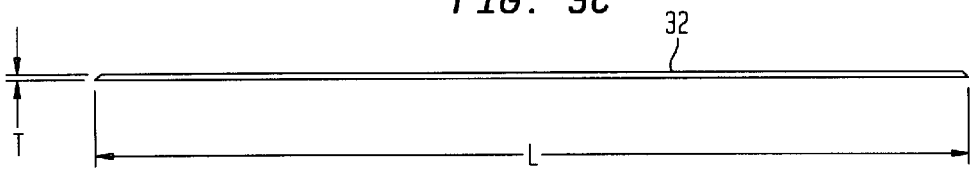
FIG. 3C is a side view of the metal strip which forms the two pins before it has be bent and soldered to the back of the ornament.

FIGS. 3A and 3B illustrate the attachment clip 20 in better detail. Attachment clip 20 is formed from a single strip of metal 32 having a defined thickness T, a width W, and a length L as shown. Prior to attaching the clip 20 to the back 18 of the ornament 14, the two ends thereof are bent upwardly to form the bodies of first pin 22 and second pin 26 which are connected together by the median section 36. First pin 22 includes a beveled tip 24 and, likewise, the second pin 26 includes a beveled tip 28. The tips 24 and 28 are beveled at an angle of approximately B=45° with respect to the long axis of pins 24 and 28. In addition, the first pin 22 and second pin 26 are bent away at an angle of approximately A=10–15° from an axis perpendicular to the back 18 of ornament 14 and the long axis of the median section 36. A soldered joint 30 connects the median section 36, shown in profile in FIG. 2, to the mid portion of the back 18 of ornament 14 in a conventional fashion.

The ornament 14 serves two primary purposes. First, it acts as added decoration to the candle, which could be used to define the character of the candle relative to a specific holiday or season. For example, a Christmas Santa might be appropriate for Christmas; an Easter Bunny might be appropriate for Easter; a pair of lovers might be appropriate for Valentine's Day, etc. Second, once the candle 12 is used by the consumer and burns to the appropriate level, the ornament 14 will simply fall off, i.e., will not be burned or destroyed, and then could be used on another candle or as a decorative ornament on an item such as a Christmas Tree or the like as previously described.

The primary unique feature of the invention 10 is the attachment clip 20 and its construction. The ornament 14 is preferably made of a thin metal, such as tin, of the appropriate weight and density, that will allow the ornament 14 to be properly set into the outer skin 38 of the relatively soft candle 12 while not falling off the candle 12 in order to serve as decoration. Attachment clip or bracket 20 is fashioned in a such a manner that the beveled edges 24 and 28 are angled to optimally pierce the outer skin of the candle 12 establishing a firm attachment while not causing any damage to the face 38 or appearance of the candle 12 thereby causing the candle surface to flake off and loose its holding capacity. This structure permits the ornament 14 to be removed prior to the burning of the candle 12, if desired, without causing any damage to the skin 38 of the candle 12. Attachment bracket or clip 20 needs to be constructed to a specific length L that will allow a balance of the weight of the ornament 14 to be properly distributed on the side wall or face 38 of the candle 12 and not fall off the candle 12 until the end of the burning cycle of the candle 12 is almost complete. The first and second pin faces 24 and 28 are formed and cut to a precise angle B=45° in order to establish a deep enough penetration into the candle 12 without compromising the strength or outer appearance of the candle 12. Similarly, the tin ornament 14 is constructed of other quality tin that will not conduct any significant amount of heat while the candle 12 is burning. The size and weight of the ornament 14 must be proportionate to the size of each candle 12 because candles 12 are often made in numerous sizes and shapes in a typical product line. The constructive angle A of the first and second pin 22 and 26 is precisely developed in order to allow the first and second pin 22 and 26 to fit properly while creating an allusion of the ornament 14 having a Three-D rather than a flat characteristic when lying against the side wall 38 of the candle 12. Accordingly, it is critical that each pin 22 and 26 be bent to the correct angle, preferably A=10–15° from perpendicular, which allows this unusual effect for each candle 12.

According to the preferred embodiment of the invention 10, the attachment clip or bracket 20 comprises a piece of tin having a thickness T of approximately $1/64^{th}$ of an inch and a width W of approximately $1/8^{th}$ of an inch. Initially, the metal strip of tin 32 has a length L of approximately 2¼th inches. The strip 32 is then bent so as to form the first and second pins or tabs 22 and 26 which are each respectively, approximately one-half of an inch long. The free ends 24 and 28 of the first and second pins 22 and 26, respectively, are beveled at an angle of approximately 45° so as to form a sharp leading edge that can cut into the surface 38 of the candle wax without causing the supporting surface to flake off. The connecting or median section 36, between the two pins 22 and 26, is welded by means of a conventional soldered joint 30 to the back 18 of the ornament 14 such that the long axis, that is to say the axis of the connecting portion 36, of the clip or attachment means 20 is roughly horizontal to and parallel to the long axis of the ornament 14.

The invention or apparatus 10 is assembled by placing the long axis of the ornament 14 in roughly the same direction as the long axis of the candle 12 and then gently pressing the pins 22 and 26 in at the same time until the ornament back 18 is flush with the face or side wall 38 of the candle 12. The ornament 14 should stay in that position indefinitely or until the candle 12 burns down to a point where the ornament 14 looses its support and naturally falls off. This unique arrangement permits the ornament 14 to be attached to the back 38 of the candle 12 securely without falling off, but will fall off at the right time so it can be used as a tree ornament or, perhaps, placed on another candle 12. The invention 10 has a number of advantages over the prior art:

First, it is relatively easy to manufacture.

Second, the ornament 14 serves the dual purpose of decorating a candle 12 and, then subsequently decorating a holiday object, such as a Christmas Tree, Wreath, Fireplace, etc. Alternatively, when the ornament 14 falls off of its candle support 12, it could then be placed on another candle 12 where it serves the same function.

Third, the shape and inclination of the pins 22 and 26 is such that they pierce the outer skin 38 of a candle 12 establishing a firm attachment thereto while not causing any damage to the face 38 or appearance of the candle 12 thereby causing the candle surface 38 to flake off and loose its holding capacity.

Fourth, the structure of the ornament 14 is such that it is especially good with modern candles 12 which have a relatively soft surface, such as those made with coconut oil.

Fifth, depending upon the location of the attachment clip or bracket 20 on the back 18 of the ornament 14, the ornament 14 may not separate from the candle 12 until the candle 12 is at least 50% depleted or more. The use of two pins keeps the ornament 14 from cocking or tilting with respect to the long axis of the candle 12 and the broad beveled inclined tips 24 and 28 provide firm attachment without serious damage thereto.

While the invention has been described with reference to the preferred embodiment thereof, it will be appreciated by those of ordinary skill in the art that various modifications can be made to the structure of the invention without departing from the spirit and scope thereof.

What is claimed is:

1. An ornament apparatus for use with a holiday candle comprising:

an ornament body having a front ornamental face and a rear face; and, pin means for attaching said ornament body to said candle, wherein said pin means comprises:

a metallic strip having a length L and having a rectangular cross section including a front and a back face and a first and second edge face, wherein said front and back faces have a width dimension W and said edge faces have a thickness dimension T and wherein W is bigger than T;

at least a first relatively sharp pin member that can be pushed into the body of said candle so that said ornament will stay in place during normal handling;

a median section having a first and a second end; and, a second pin member, wherein said first pin member is attached to said first end of said median section and said second pin member is attached to said second end of said median section;

said pin means attaching said ornament body to said candle so that as said candle melts, said ornament falls away from said candle.

2. The apparatus of claim 1 wherein said ornament is made substantially of metal and said pin means is soldered to said rear face of said ornament body.

3. The apparatus of claim 2 wherein said first and second pin members each have sharpened, beveled tips for insertion into said candle.

4. The apparatus of claim 3 wherein said first and second pin members are each inclined at an angle A in the range of 10° to 15° away from the plane of said front and back faces of said median section.

5. The apparatus of claim 4 wherein said angle A is approximately 10° wherein said ornament is held securely to said candle until said candle melts to a point below at least one of said pin members.

6. The apparatus of claim 5 further comprising:

hanging means connected to said ornament body for attaching said ornament to a holiday display.

7. The apparatus of claim 6 wherein said candle comprises a candle made of relatively soft wax material including coconut oil.

8. The apparatus of claim 7 wherein the first and second pin members each include a beveled face which is beveled at an angle B of approximately 45° with respect to the long axis of said first and second pin members.

* * * * *